United States Patent [19]

Collie et al.

[11] Patent Number: 4,753,539

[45] Date of Patent: Jun. 28, 1988

[54] QUICK RESEAL SYSTEM

[76] Inventors: William H. Collie, 1308 Bynum Rd., Bartlesville, Okla. 74006; George Spector, 233 Broadway RM 3815, New York, N.Y. 10007

[21] Appl. No.: 56,000

[22] Filed: Jun. 1, 1987

[51] Int. Cl.[4] ..... B65D 27/12

[52] U.S. Cl. ..... 383/41; 383/66; 383/71; 229/87 B

[58] Field of Search ..... 383/66, 41, 71, 2; 229/87 B

[56] References Cited

U.S. PATENT DOCUMENTS

| | | | |
|---|---|---|---|
| 355,417 | 1/1887 | Spencer | 383/41 |
| 821,986 | 5/1906 | Coburn | 383/41 |
| 1,287,935 | 12/1918 | Fegeley | 383/71 |
| 1,994,945 | 3/1935 | Cook | 383/71 |
| 2,318,735 | 5/1943 | Bickford | 383/41 |
| 2,522,480 | 9/1950 | Davis | 383/66 |
| 2,588,409 | 3/1952 | Olsen | 229/87 B |
| 3,143,153 | 8/1964 | Smith | 383/41 |
| 3,290,854 | 12/1966 | MacMurray | 383/71 |
| 3,417,912 | 12/1968 | Paxton | 383/71 |
| 3,519,196 | 7/1970 | Paxton | 383/71 |

FOREIGN PATENT DOCUMENTS

| | | | |
|---|---|---|---|
| 549840 | 12/1957 | Canada | 383/66 |
| 571439 | 3/1959 | Canada | 383/71 |
| 2234284 | 1/1974 | Fed. Rep. of Germany | 383/71 |

*Primary Examiner*—Stephen P. Garbe

[57] ABSTRACT

A quick reseal system is provided and consists of a slideable fastener over twisted end of a bag that has an elongated aperture in sidewall to allow items to be removed therefrom when the fastener is manually moved to other side of the aperture.

4 Claims, 1 Drawing Sheet

QUICK RESEAL SYSTEM

BACKGROUND OF THE INVENTION

The instant invention relates generally to packages and more specifically it relates to a quick reseal system.

Numerous packages have been provided in prior art that are adapted to be openable and closeable so that contents can be removed therefrom and stored therein. For example, U.S. Pat. Nos. 3,334,805; 3,428,240 and 4,335,817 all are illustrative of such prior art. While these units may be suitable for the pacticular purpose to which they address, they would not be as suitable for the purposes of the present invention as heretofore described.

SUMMARY OF THE INVENTION

A primary object of the present invention is to provide a quick reseal system that will overcome the shortcomings of the prior art devices.

Another object is to provide a quick reseal system that utilizes a slideable fastener over twisted end of a bag that has an elongated aperture in sidewall to allow items to be removed therefrom when fastener is moved to a proper position.

An additional object is to provide a quick reseal system in which the fastener is an expandable closure clip to easily slide upon the twisted end of the bag.

A further object is to provide a quick reseal system that is simple and easy to use.

A still further object is to provide a quick reseal system that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
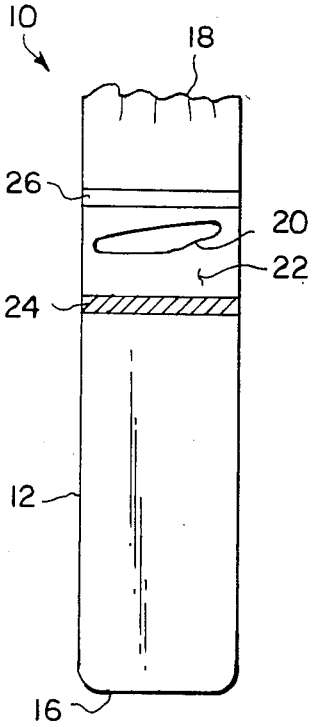
FIG. 1 is a plan view of the invention showing the bag in a flatened condition without any contents.
Figure 2:
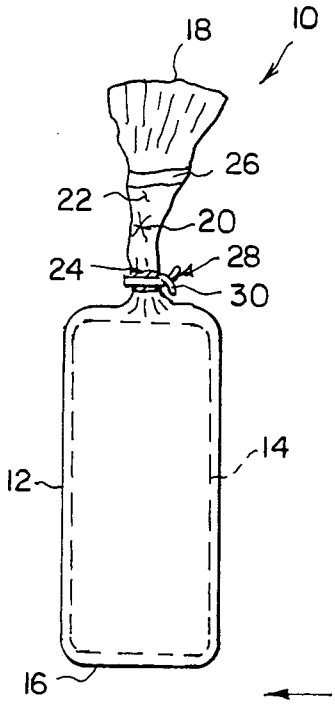
FIG. 2 is a plan view of the invention showing the bag with bread inside and tie thereon.

Turning now descriptively to the drawings, in which similar reference characters denote similar elements throughout the several views, FIGS. 1 and 2 illustrate a quick reseal system 10 consisting of a bag 12 of flexible twistable material for holding a plurality of items 14 therein, such as a loaf of sliced bread. The bag 12 has a closed end 16, an open end 18 and an elongated aperture 20 formed in sidewall 22 adjacent the open end 18 thereof. A pair of bands 24 and 26 are each printed around the bag 12 on either side of and adjacent to the elongated aperture 20. The first band 24 is positioned between the elongated aperture 20 and the closed end 16 while the second band 26 is positioned between the elongated aperture 20 and the open end 18. A fastener 28 is placed around the first band 24 when the bag 12 is twisted for sealing the bag. The fastener 28 can be manually pulled to slide over to the second band 26 allowing the elongated aperture to open so that a desired amount of the items 14 in the bag 12 can be removed therefrom.

As shown in FIG. 2 the fastener 28 is a twist member 30 which includes a wire strap covered by paper that is slideable along the twisted end of the bag 12 so as to travel between the first band 24 and the second band 26.

Figure 4:
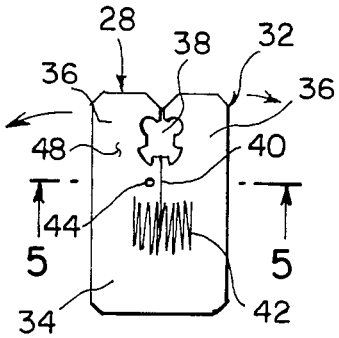
FIG. 4 is an enlarged plan view of the closure clip in FIG. 3.
Figure 5:
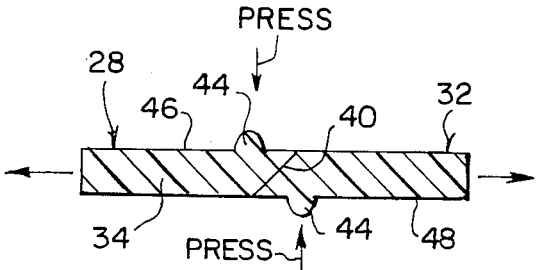
FIG. 5 is an enlarged cross sectional view taken along line 5—5 in FIG. 4 showing the wedge slot in greater detail.
Figure 3:
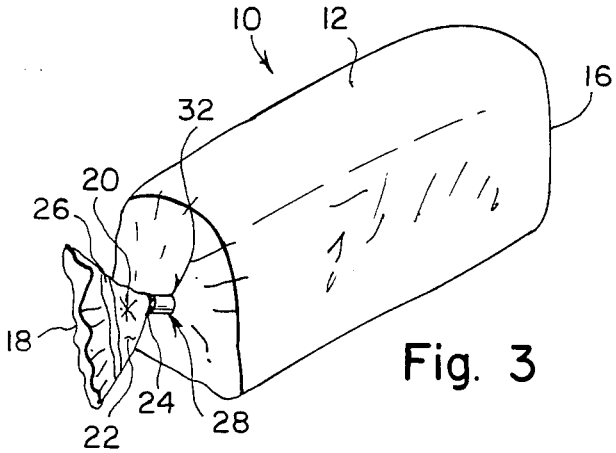
FIG. 3 is a perspective view of a modification in which an improved closure clip is utilized.

As shown in FIGS. 3, 4 and 5 the fastener 28 is a closure clip 32 that consists of a relatively rigid member 34 that has parts 36 defining a space 38 for receiving therebetween the twisted portion of the bag 12. A split wedge slot 40 extends away from the space 38 to accordian pleats 42 formed within the closure clip 32. A pair of detents buttons 44 are provided, in which each is formed on an opposite surface 46 and 48 of the closure clip 32 on either side of the split wedge slot 40. When the detent buttons 44 are pressed together each half of the split wedge slot 40 will slide upon each other causing the closure clip 32 to move apart with the accordian pleats 42 expanding thus enlarging the space 38 for receiving the twisted portion of the bag 12 allowing the closure clip 32 to easily slide thereupon.

Figure 6:
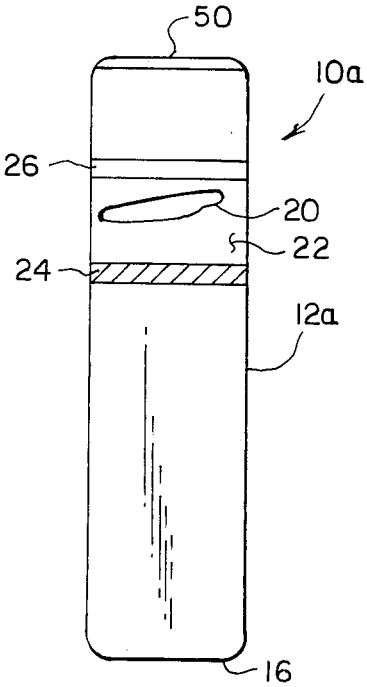
FIG. 6 is a plan view similar to FIG. 1, showing a modification in which the open end is vacuum sealed.

FIG. 6 shows a modified bag **12*a* wherein the open end of the bag is now vacuum sealed at 50 so that the system 10*a* is adapted to hold various items therein, such as crackers, potato chops, cookies and the like. All other features of the bag 12*a* is exactly like the bag 12 shown in FIGS. 1, 2 and 3**.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A quick reseal system which comprises:

(a) a bag of flexible twistable material for holding a plurality of items therein, said bag having a closed end, an open end and an elongated aperture formed in sidewall adjacent the open end thereof;

(b) a pair of bands, each printed around said bag on either side of and adjacent to the elongated aperture, in which said first band is positioned between the elongated aperture and the closed end while said second band is positioned between the elongated aperture and the open end; and (c) a fastener placed around the first band when said bag is twisted for sealing said bag whereby said fastener can be manually pulled to slide over to the second band allowing the elongated aperture to open so that a desired amount of the items in said bag can be removed therefrom.

2. A quick reseal system as recited in claim 1, wherein said fastener is a twist member which includes a wire strip covered by paper that is slideable along the twisted end of said bag so as to travel between the first band and the second band.

3. A quick reseal system as recited in claim 1, wherein said fastener is a closure clip comprising a relatively rigid member having parts defining a space for receiving therebetween the twisted portion of said bag, a split wedge slot extending away from the space to accordian pleats formed within said closure clip and a pair of detent buttons each of which is formed on an opposite surface of said closure clip on either side of said split wedge slot so that when said detent buttons are pressed together each half of said split wedge slot will slide upon each other causing said closure clip to move apart with the accordian pleats expanding thus enlarging the space for receiving the twisted portion of said bag allowing said closure clip to easily slide thereupon.

4. A quick reseal system as recited in claim 1, wherein the open end of said bag is vacuum sealed so that said system is adapted to hold various items therein, such as crackers, potato chips, cookies and the like.

* * * * *